US012611042B2

(12) United States Patent
Murphy

(10) Patent No.: US 12,611,042 B2
(45) Date of Patent: Apr. 28, 2026

(54) ADJUSTABLE SLEEP SYSTEM WITH INDEPENDENT SECTIONS

(71) Applicant: Keith Randall Murphy, Jersey City, NJ (US)

(72) Inventor: Keith Randall Murphy, Jersey City, NJ (US)

( * ) Notice: Subject to any disclaimer, the term of this patent is extended or adjusted under 35 U.S.C. 154(b) by 30 days.

(21) Appl. No.: 18/885,321

(22) Filed: Sep. 13, 2024

(65) Prior Publication Data

US 2026/0076485 A1 Mar. 19, 2026

(51) Int. Cl.

| | |
|---|---|
| ***A47C 19/04*** | (2006.01) |
| ***A47C 20/04*** | (2006.01) |
| ***A47G 9/02*** | (2006.01) |

(52) U.S. Cl.

CPC ..... *A47C 19/04* (2013.01); *A47C 20/041* (2013.01); *A47C 20/042* (2013.01); *A47C 20/048* (2013.01); *A47G 9/0292* (2013.01)

(58) Field of Classification Search

CPC ..... A47C 19/04; A47C 20/041; A47C 20/042; A47C 20/048; A47G 9/0292; B60P 3/36; B60P 3/39; B60P 3/38; F16B 12/50

USPC ..... 5/11

See application file for complete search history.

(56) References Cited

U.S. PATENT DOCUMENTS 1,274,851 A * 8/1918 Byrd ..... A61G 7/015 5/613
1,580,014 A 4/1926 Christiansen
1,866,397 A * 7/1932 Clewley ..... A61G 13/0009 5/604
2,373,017 A * 4/1945 Deckert ..... A61G 7/015 5/618
2,502,752 A 4/1950 Richards (Continued)

FOREIGN PATENT DOCUMENTS

| | | |
|---|---|---|
| CN | 108433477 A | 8/2018 |
| EP | 4279052 | 11/2023 |
| WO | 2015/005666 A1 | 1/2015 |

OTHER PUBLICATIONS

Kempfe et al., Association between the side of unilateral shoulder pain and preferred sleeping position: a cross-sectional study of 83 Danish patients, J Manipulative Physiological Therapeutics, www.ncbi.nlm.nih.gov/pmc/articles/PMC10847686, (Jun. 2012), vol. 35, No. 5, pp. 407-412.

(Continued)

*Primary Examiner* — Justin C Mikowski
*Assistant Examiner* — Luke Hall
(74) *Attorney, Agent, or Firm* — TraskBritt

(57) ABSTRACT

An adjustable sleep system includes a first bed section having a first length and configured to support a user's legs and torso. The sleep system also includes a second bed section adjacent to the first bed section having a second length and configured to support a user's arms, shoulders, and head. At least one of the first bed section or second bed section includes a height adjustment mechanism adapted to adjust a height of the first bed section or second bed section. In various embodiments, the first length is about 3 to about 4 times the second length. In various embodiments, the sleep system may also include a pivotally adjustable platform pivotally attached to the second bed section adapted to change the angle of the pivotally adjustable platform relative to the second bed section and/or the first bed section.

20 Claims, 8 Drawing Sheets

(56) References Cited

U.S. PATENT DOCUMENTS

| | | | | |
|---|---|---|---|---|
| 2,547,827 | A * | 4/1951 | Logan | A61G 7/015 5/613 |
| 2,668,964 | A | 2/1954 | Simmons | |
| 3,795,018 | A * | 3/1974 | Broaded | A61G 7/05723 5/613 |
| 3,991,428 | A * | 11/1976 | Hanson | A61G 7/1019 5/616 |
| 4,461,047 | A * | 7/1984 | Lindley | A61G 7/0005 5/604 |
| 7,644,460 | B2 | 1/2010 | Calvo | |
| 9,622,603 | B1 * | 4/2017 | Coats | A47G 9/0246 |
| 2018/0070748 | A1 * | 3/2018 | Bell | A47G 9/04 |
| 2018/0192795 | A1 * | 7/2018 | Pacquette | A47G 9/0292 |
| 2018/0242751 | A1 * | 8/2018 | MacNaughton | A47C 20/042 |

OTHER PUBLICATIONS

Richards et al., Rotator Cuff Tears are Related to the Side Sleeping Position, Arthrosc Sports Med Rehabil., (Feb. 2024), www.ncbi.nlm.nih.gov/pmc/articles/PMC10847686, vol. 6, No. 2.

Suni et al., Best Sleeping Positions, (Apr. 10, 2024), https://www.sleepfoundation.org/sleeping-positions, 10pages.

* cited by examiner

ADJUSTABLE SLEEP SYSTEM WITH INDEPENDENT SECTIONS

TECHNICAL FIELD

This disclosure relates generally to beds. More particularly, it relates to adjustable beds or bed supports that alter the relative positions of different portions of the bed.

BACKGROUND

Many people suffer pain or discomfort during and after sleep due to poor sleeping posture. For example, when a person sleeps on their side, the shoulder must bear a significant part of the weight of the torso because, for most people, the shoulder extends out beyond the torso. Moreover, the torso provides a far greater surface area to support the body's weight, as compared to focusing that weight pointedly on the shoulder. At least one study has shown a 67% correlation between chronic shoulder pain and sleeping on the impaired shoulder. "Association between the side of unilateral shoulder pain and preferred sleeping position: a cross-sectional study of 83 Danish patients" Bo Kempf et al., J Manipulative Physiol Ther. 2012 June; 35(5): 407-12. <pubmed.ncbi.nlm.nih.gov/22608285/>. Another study notes that the decubitus (side sleeping) position results in the most subacromial (shoulder) pressure when compared with the other common sleep positions, and the study correlated side-sleeping with rotator cuff tears and damage. David P. Richards, M.D., F.R.C.S.C., et al., Rotator Cuff Tears Are Related to the Side Sleeping Position, Arthrosc Sports Med Rehabil. 2024 April, <www.ncbi.nlm.nih.gov/pmc/articles/PMC10847686/>. Side sleeping also can cause or exacerbate back, shoulder, and neck pain due to excess weight on the shoulder and misalignment of the spine in the back and/or neck. Separately, sleeping on the stomach, for those who prefer that sleep posture, can cause back and neck pain due to awkward back support and the neck and head being misaligned in an exaggerated upward position or otherwise improperly supported.

Eric Suni and Dr. Abhinav Singh, Best Sleeping Positions, Apr. 10, 2024, <www.sleepfoundation.org/sleeping-positions> (discussing risks and benefits of various sleeping positions). A bed that is designed to customize an optimal sleep position for users is needed.

BRIEF SUMMARY

The disclosure relates to an adjustable sleep system. The sleep system includes a first bed section having a first length and configured to support a user's legs and torso. The sleep system also includes a second bed section adjacent to the first bed section having a second length and configured to support a user's arms, shoulders, and head. At least one of the first bed section or second bed section includes a height adjustment mechanism adapted to adjust a height of the first bed section or second bed section. In various embodiments, the first length is about 3 to about 4 times the second length.

BRIEF DESCRIPTION OF THE DRAWINGS

For a detailed understanding of the disclosure, reference should be made to the following detailed description, taken in conjunction with the accompanying drawings, in which like elements have generally been designated with like numerals, and wherein.

DETAILED DESCRIPTION

Figure 1:
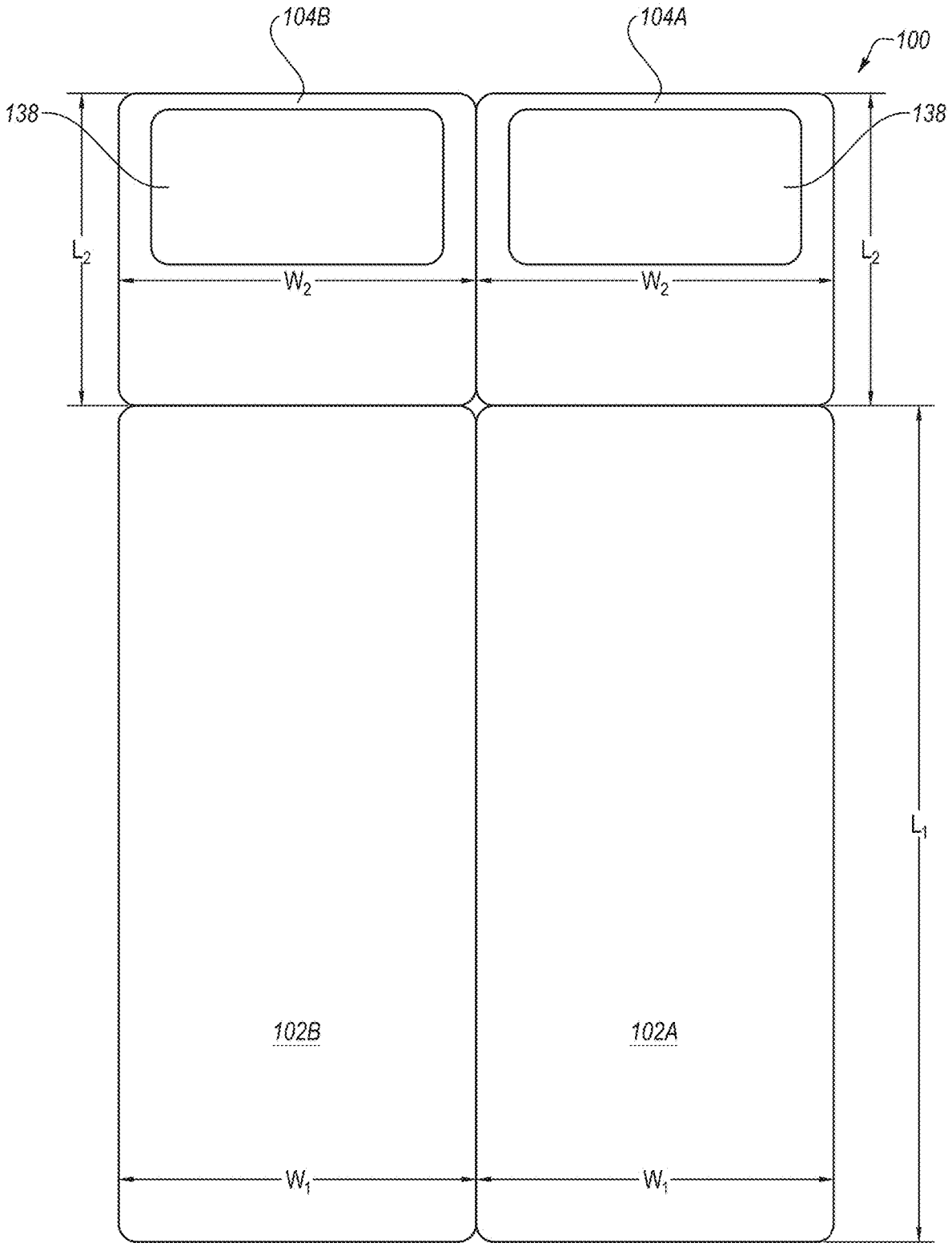
FIG. 1 is a top plan view of an exemplary embodiment of a sleep system, according to the present disclosure.

This disclosure relates to sleep systems designed to provide a more ergonomic sleep position for users with various sleep positions and across a wide range of body types and sizes. The disclosed sleep systems include multiple sections, at least some of which are independently adjustable in height (e.g., elevation off the floor or bed frame/support) to provide a more ergonomically optimal sleep position.

Drawings presented herein are for illustrative purposes only and are not meant to be actual views of any particular material, component, structure, device, or system. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," "above," "beneath," "side," "upward," "downward," etc., is used for clarity and convenience in understanding the disclosure and accompanying drawings, and does not connote or depend on any specific preference or order, except where the context clearly indicates otherwise. For example, these terms may refer to an orientation of elements of any sleep system when utilized in a conventional manner. Furthermore, these terms may refer to an orientation of elements of any sleep system as illustrated in the drawings.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or at least 99.9% met.

As used herein, the term "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the term "length" refers to measurements along an axis in the direction between the foot and head of the bed. As used herein, the term "width" refers to measurements along an axis in the direction between sides of the bed. As used herein, "height" refers to vertical measurements.

As used herein, the term "head" in relation to a bed refers to the end of the bed intended and adapted to support a user's head. As used herein, the term "foot" in relation to a bed refers to the end of the bed intended and adapted to support feet (i.e., the opposite end from the head of the bed).

Referring to FIG. 1, an exemplary embodiment of a sleep system 100 (e.g., bed) is illustrated. The sleep system has a first bed section 102B and/or 102A (collectively 102) and a second bed section 104A and/or 104B (collectively 104). Each first bed section 102 has a length $L_1$ and a width $W_1$ and may have one or more parts (e.g., a left first section and a right first section). Each second bed section 104 also has a length $L_2$ and a width $W_2$ and may have one or more parts (e.g., a left second bed section 104B and a right second bed section 104A). The first bed section 102 may comprise a sleep support (e.g., a mattress, boxspring) on a bed frame 110 (shown in FIG. 2) and/or boxspring. The second bed section 104 may also comprise a sleep support (e.g., a mattress) on the bed frame 110 and/or boxspring. By way of non-limiting example, the sleep system 100 shown in FIG. 1 includes a single first bed section 102 and two second bed sections 104A, 104B adapted to adjust independently for use by two sleepers. In various embodiments, the sleep system 100 may have the same number of first bed sections 102 and second bed sections 104. In other embodiments, a sleep system may have more of one or the other of first bed sections 102 and second bed sections 104.

In various embodiments, the combined first and second bed sections have total dimensions corresponding to conventional bed sizes (e.g., twin, full (double), queen, king) to be compatible with conventional boxsprings, platform beds, bedding (e.g., blankets, bedspreads). In various embodiments, the length $L_1$ of the first bed section is about three (3) to about four (4) times the length $L_2$ of the second bed section. In various embodiments, the total length ($L_1$ plus $L_2$) is about 80 inches. In various embodiments, the length $L_1$ of the first bed section is about 60 inches to about 64 inches, (e.g., 62 inches) and the length $L_2$ of the second bed section is about 16 inches to about 20 inches (e.g., 18 inches). In other embodiments, the total length ($L_1$ plus $L_2$) of the bed may be about 75 inches or about 84 inches. In various exemplary embodiments, the width of the sleep system is about 38 inches, about 54 inches, about 60 inches, about 72 inches, or about 76 inches. In embodiments with more than one first bed section 102 and/or second bed section 104, the total width of the first bed sections 102 is equal to the total width of the second bed sections 104. In various embodiments having more than one first bed section 102, the widths $W_1$ of the two bed sections may be the same or may differ. In various embodiments having more than one second bed section 104, the widths $W_2$ of the two bed sections may be the same or may differ. In various embodiments, the total width ($\Sigma W_1$) of the first bed sections 102 is equal to the total width ($\Sigma W_2$) of the second bed sections 104 ($\Sigma W_1 = \Sigma W_2$).

Figure 2:
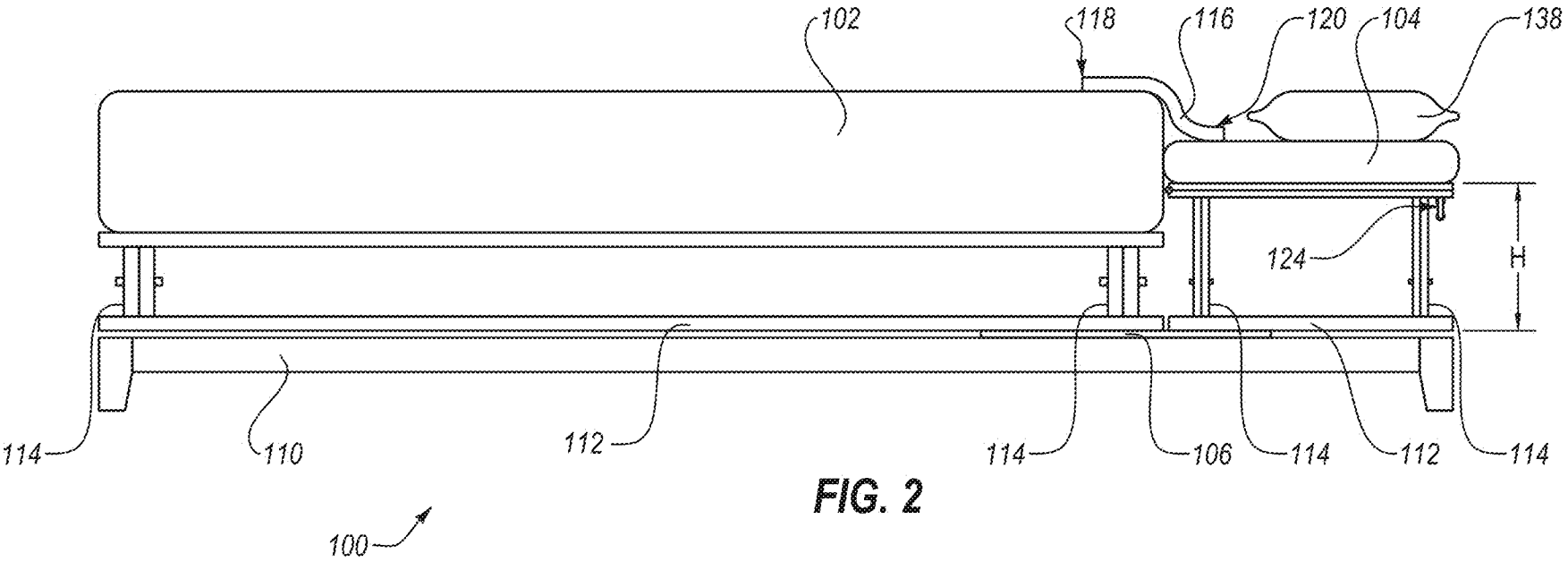
FIG. 2 is a side plan view of the embodiment of FIG. 1.

Referring to FIG. 2, exemplary embodiments of a sleep system 100 comprise one or more height adjustment mechanisms 114 in the first bed section 102 and/or second bed section 104 configured to raise or lower at least one of a first bed section 102 or a second bed section 104. In various embodiments, the one or more height adjustment mechanisms 114 are incorporated into (e.g., under) the first bed section 102 and/or second bed section 104. In the embodiment shown in FIG. 2, the height adjustment mechanisms 114 are adapted to adjust the position (e.g., height) of the first bed section 102 and/or second bed section 104 to a given height H. In various embodiments, such as the embodiment of FIG. 1, the sleep system 100 comprises two second left and right bed sections (e.g., left first and left second bed sections 102B and 104B, respectively; and right first and right second bed sections 102A and 104A, respectively). In such embodiments, the second bed sections 104 (e.g., a left second bed section 104B and a right second bed section 104A) may each comprise at least one height adjustment mechanism 114 (e.g., a first height adjustment mechanism and a second height adjustment mechanism). In various embodiments, first bed section 102 may be a single mattress with a width corresponding to conventional bed sizes (e.g., full (double), queen, king). The first bed section(s) 102 and the second bed section(s) 104 may be adapted to fit onto a single bed frame 110 and/or boxspring. In various embodiments, the bed frame 110 may be any conventional bed frame and/or boxspring.

In various exemplary embodiments, such as shown in FIG. 2, the height adjustment mechanisms 114 are connected to a frame/platform 112 that supports the sleeping portion of the first bed section 102 and/or second bed section 104. The frame/platform 112 may help control or constrain the positions and movements of the height adjustment mechanisms 114 to maintain appropriate positioning and height adjustment.

Still referring to FIG. 2, in some embodiments, a transitional cover 116 may be used to cover the gap between the first bed section 102 and second bed section 104 for aesthetic reasons and user comfort. The transitional cover may comprise a relatively thin material that is connected to the first bed section 102 and second bed section 104 along a first edge 118 and a second edge 120, respectively. In other embodiments, bedding (e.g., a bottom sheet) may be designed with appropriate dimensions and stretchability to provide coverage over the gap. In various embodiments, separate fitted bottom sheets may be used for first bed section 102 and second bed section 104.

Referring to FIG. 2, exemplary embodiments of a sleep system 100 comprise a connector 106 under first bed section 102 and second bed section 104 (e.g., under the supports). Connector 106 functions to maintain first bed section 102 and second bed section 104 in close proximity to each other and avoid formation of a gap between them. Connector 106 may be any thin material, preferably rigid, that is resistant to tearing, stretching, etc.

Figure 3:
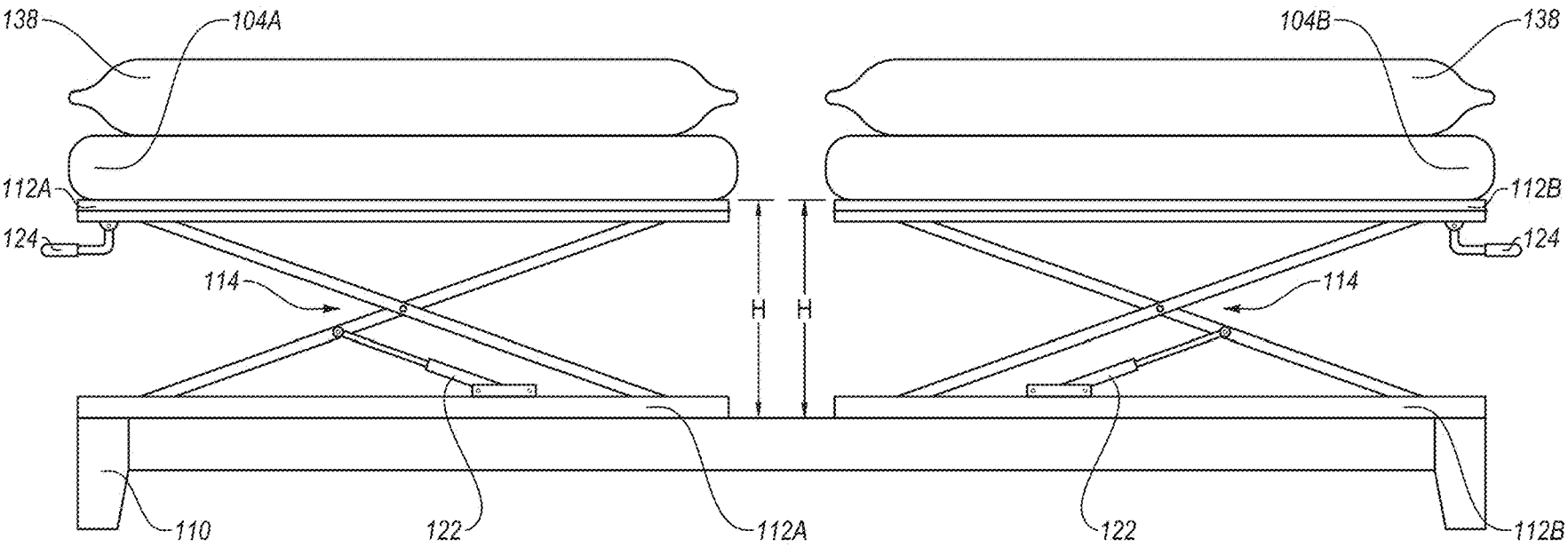
FIG. 3 is a top end plan view of a second bed section of the embodiment of FIG. 1.

Referring to FIG. 3, an exemplary embodiment of a height adjustment mechanism 114 in second bed section 104 is illustrated. The lifting mechanism is illustrated as a scissor lift with an actuator 122. However, other types of lifting mechanisms known in the mechanical arts may be used. By way of non-limiting examples, height adjustment mechanism 114 may be a linear or a rotary actuator. The illustrated actuator 122 is a linear actuator, but the actuator 122 may be selected from other types of actuators or motors known in the art. By way of non-limiting example, the actuator 122 may be a hydraulic piston or a screw drive (e.g., lead or ball screw actuator). In various embodiments, the actuator 122 may be powered electrically or manually (e.g., a hand crank or pump). In some embodiments, the height adjustment mechanism may be made up solely of one or more actuators (e.g., four linear actuators at the corners of the first or second bed section). Although the sleep system 100 is shown with the height adjustment mechanisms 114 in both the first bed section 102 and the second bed section 104, it would be understood by persons of skill in the art that one or more height adjustment mechanisms 114 could be placed in only one or the other of the first bed section 102 and the second bed section 104 within the scope of the disclosure and claims. In various exemplary embodiments, a controller 124 (e.g., switches, control panel, etc.) may be included for the user to adjust the height and/or angle of a section of the sleep system 100.

In various embodiments, the height adjustment mechanism 114 is configured to be set or locked at discrete heights selectable by the user. In other embodiments, the height adjustment mechanism 114 can be set at any height along a continuum between a minimum height (e.g., fully lowered) and a maximum height (e.g., fully raised).

Still referring to FIG. 3, height adjustment mechanisms 114 are connected to each frame/platform 112A and 112B. Each of the frame/platforms 112A and 112B includes a controller 124 to raise and lower a second bed section independently of the other second bed section. Bed frame 110 and/or boxspring supports two second bed sections 104A and 104B and two first bed sections 102A and 102B.

Figure 4:
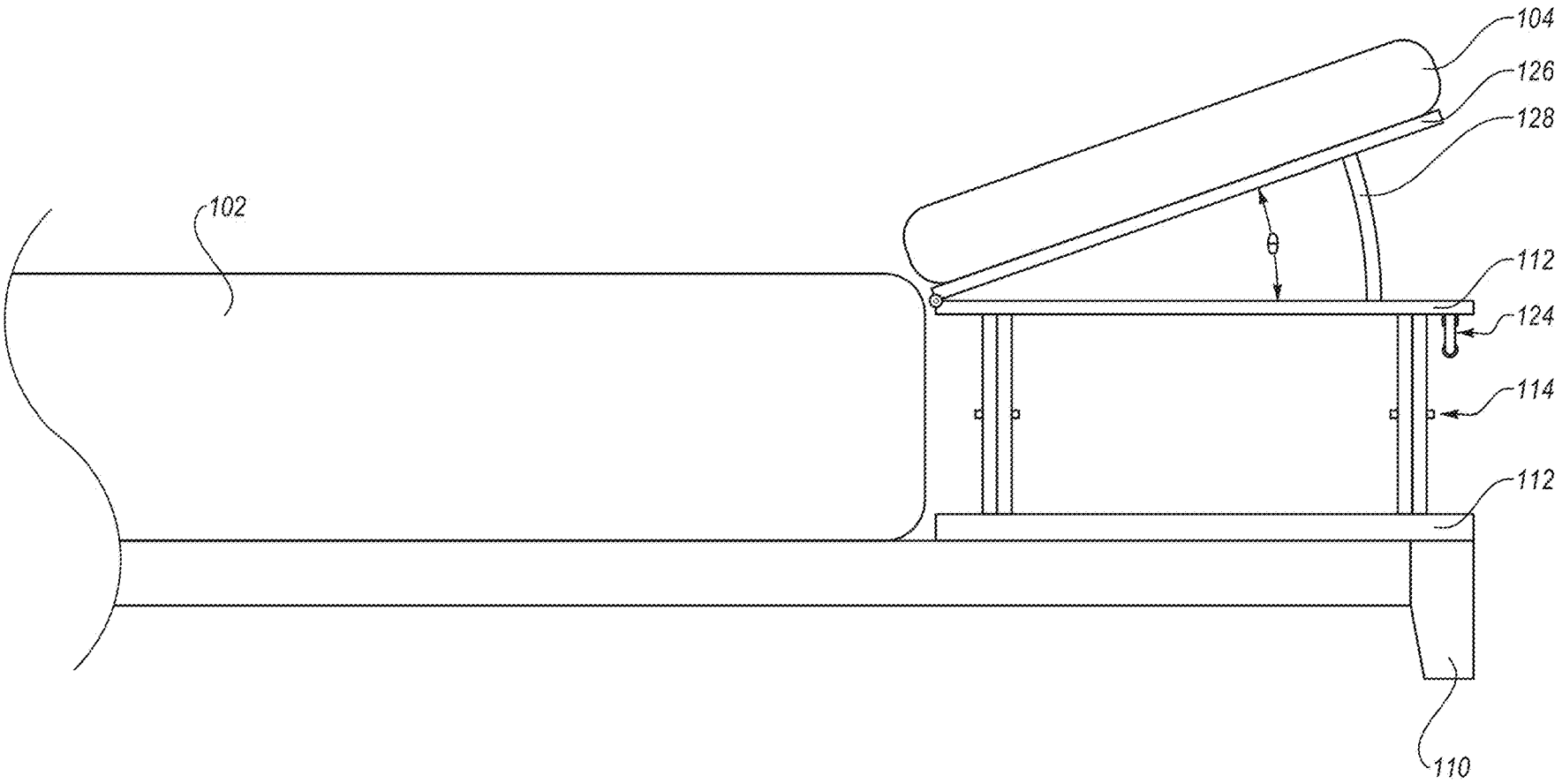
FIG. 4 is a side plan view of the embodiment of FIG. 1 with an exemplary embodiment of a head tilt mechanism, according to the present disclosure.
Figure 7:
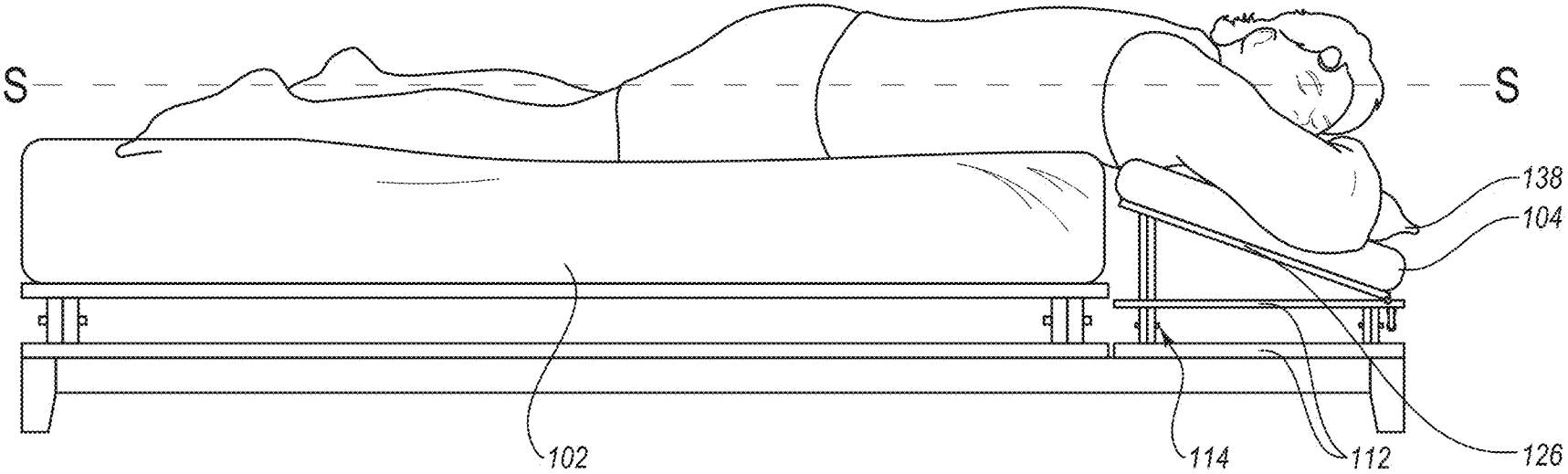
FIG. 7 is a side plan view of the embodiment of FIG. 1 showing possible adjustment for use by a stomach sleeper.

Referring to FIG. 4, a second bed section 104 may include a pivotally adjustable platform 126 that adjusts the angle θ of the second bed section 104 relative to horizontal. In various embodiments, a platform actuator 128 moves the pivotally adjustable platform to a user's selected angle θ. A position such as that shown in FIG. 4 may be beneficial for reducing sleep issues such as excessive snoring or for general comfort when reading, watching television, etc., in bed. In other embodiments, height adjustment mechanisms 114 on either side may be independently raised and lowered to adjust the angle θ of a second bed section 104 (see, e.g., FIG. 7). The position of the second bed section 104 or the pivotally adjustable platform 126 may be reversed to tilt the pivotally adjustable platform in an opposite direction (e.g., to achieve a position such as shown in FIG. 7).

Figure 5:
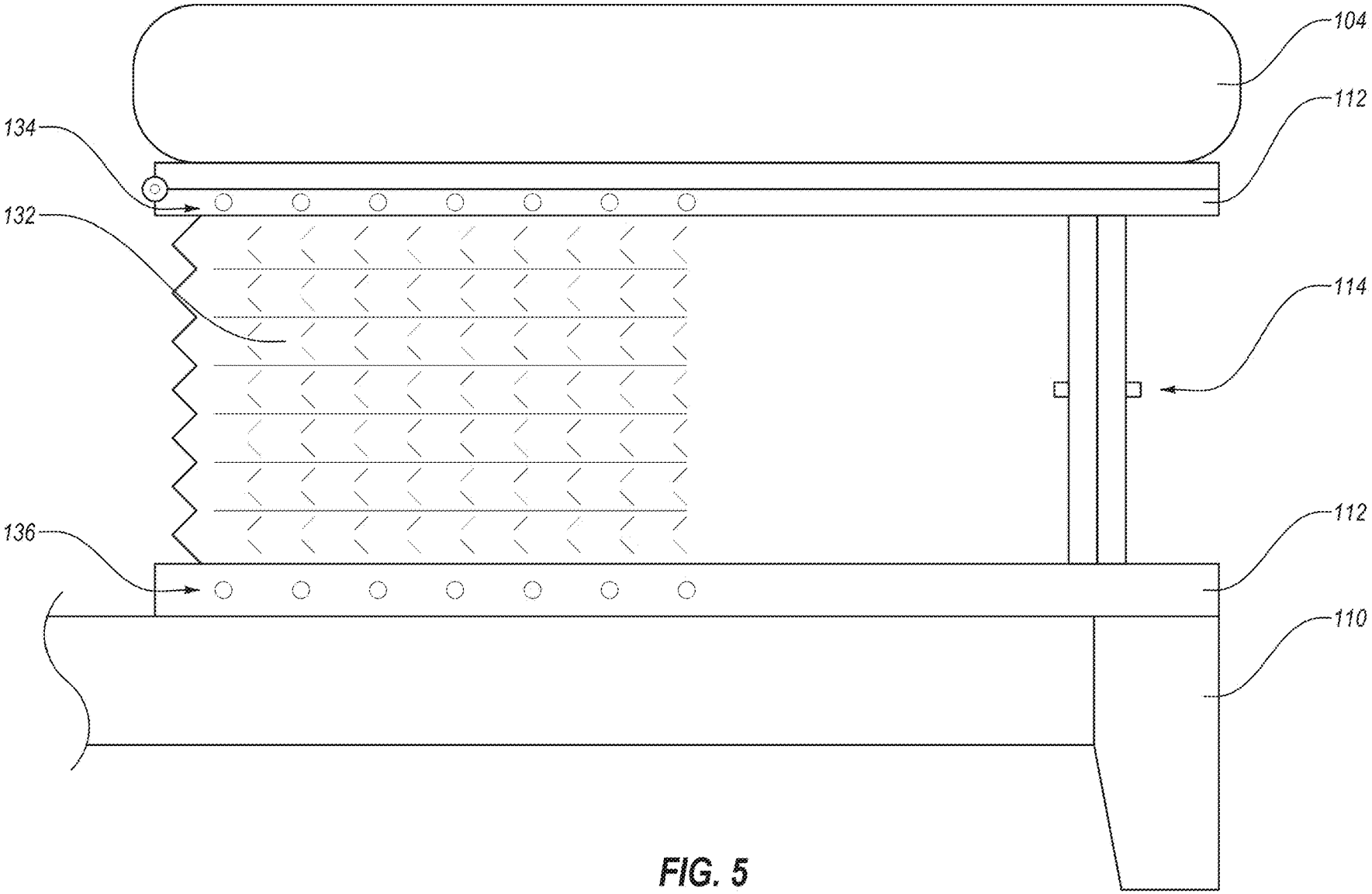
FIG. 5 is a side plan view of the embodiment of FIG. 3 with a partial view of an exemplary embodiment of a side cover, according to the present disclosure.

Referring to FIG. 5, embodiments of the sleep system 100 may include a bed skirt adapted to cover the sides of the frame/platform 112 thereby concealing the height adjustment mechanism 114 for aesthetic and/or protective reasons. In the embodiment of FIG. 5, because the height H of the second bed section 104 may be altered by the height adjustment mechanisms 114, the bed skirt 132 is connected to the second bed section along a top edge 134 and a bottom edge 136. In some embodiments, the bed skirt 132 is made from a material that is extensible (i.e., that can change its size in at least one dimension). By way of non-limiting example, the bed skirt 132 is a material that folds and unfolds in accordion fashion as it is shortened or lengthened, respectively. In other embodiments, the bed skirt 132 is a stretchable material that contracts and expands as it is shortened or lengthened, respectively.

Figure 6:
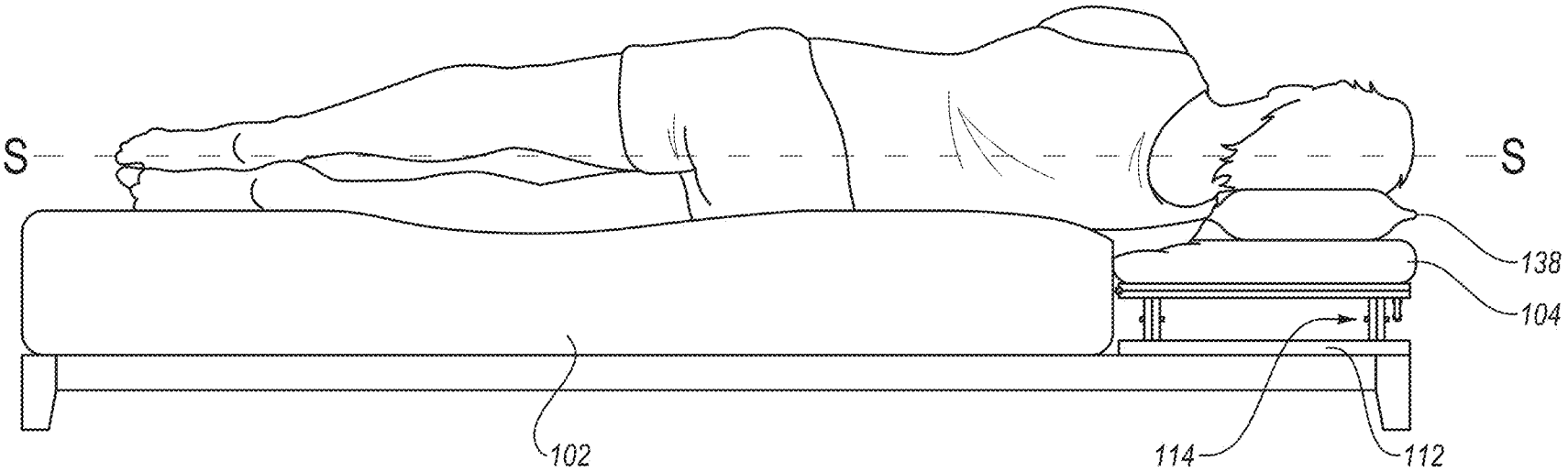
FIG. 6 is a side plan view of the embodiment of FIG. 1 showing possible adjustment for use by a side sleeper.
Figure 8:
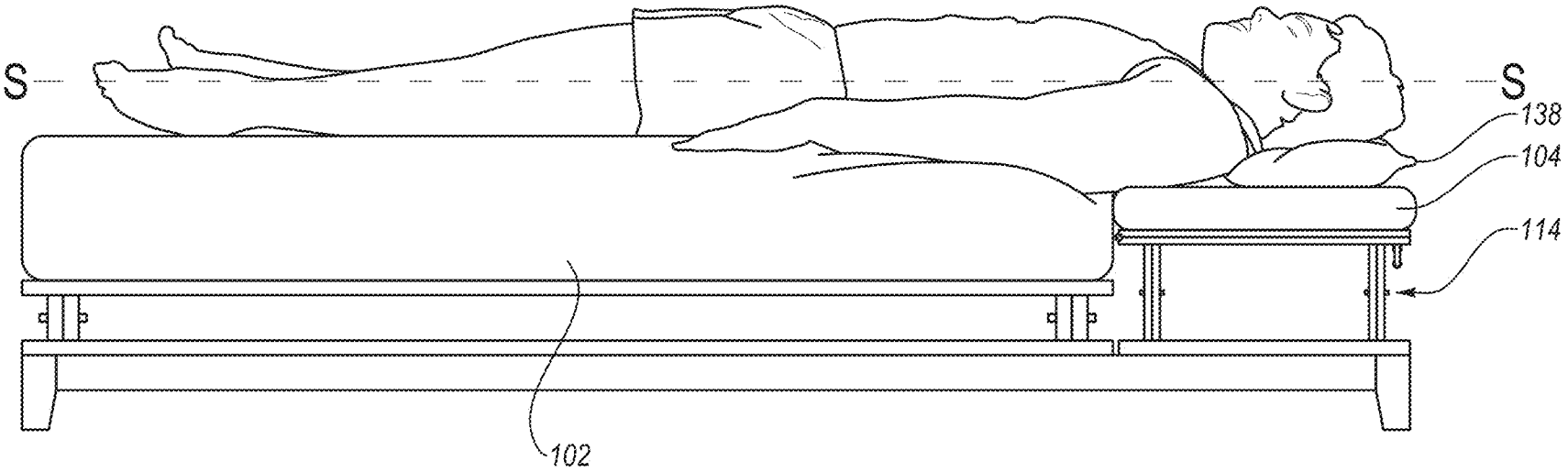
FIG. 8 is a side plan view of the embodiment of FIG. 1 showing possible adjustment for use by a back sleeper.

People come in a variety of sizes and body types. People also sleep in a variety of positions, which can be generally classified as side, front, and back sleep positions. FIGS. 6-8 illustrate methods of adjusting the configuration of the sleep system 100 for different sleep positions. It should be appreciated that the illustrated methods may be adjusted and employed for different body types and sizes. Because of the ubiquitous nature of the pillow, the users are shown employing conventional pillows 138.

Referring to FIG. 6, a typical side sleeper position is illustrated. Because the user's shoulders are wider than the rest of the torso, the second bed section 104 is lowered relative to the first bed section 102 and the user's shoulders are supported by the second bed section 104 while the head is supported by a pillow 138. By lowering the shoulders to an appropriate position, the user's spine (represented by axis S) is kept better aligned in a straight, non-kinked position, which provides a more comfortable position for better sleep and a lowered risk of back and/or neck pain or discomfort during sleep and at waking. In addition, a greater mass of the sleeper's upper body weight is now supported by the torso resting on first bed section 102, instead of being supported by the shoulder, thereby reducing/avoiding compression of the shoulder.

Referring to FIG. 7, a typical front (e.g., stomach/prone) sleeper position is shown. The second bed section 104 is lowered relative to the first bed section 102, and the platform 126 is angled up adjacent to first bed section 102 so that a typical stomach sleeper's head and shoulders can rest in greater horizontal alignment with the torso and legs (represented by axis S), and are not elevated relative to the rest of the body by the pillow 138, thus not forcing the head, neck, arms, and shoulders upward and placing undue strain and pressure on the spine, the neck, and shoulder joints. In the embodiment of FIG. 7, the angle is achieved by adjusting the height adjustment mechanisms 114 to different vertical positions along with adjustments to the angle of the pivotally adjustable platform 126.

Referring to FIG. 8, a typical back (supine) sleeper position is shown. The second bed section 104 is lowered (or, in some embodiments, first bed section 102 is raised) an appropriate distance relative to the level of the first bed section 102 such that the user's head is not misaligned (e.g., overly elevated) by the pillow 138 above a comfortable alignment of the spine in the back and neck (represented by axis S). Such adjustments allow for a more natural resting-head and neck position and can open up a user's airway, as opposed to the pillow angling the user's chin into their chest on a typical single-piece mattress with a pillow laid on top, for example.

Additional non-limiting example embodiments of the present disclosure are set forth below:

Embodiment 1: An adjustable sleep system, comprising: a first bed section having a first length and configured to support a user's legs and torso; a second bed section adjacent to the first bed having a second length and configured to support a user's arms, shoulders, and head; and at least one of the first bed section or second bed section comprising a height adjustment mechanism, the height adjustment mechanism adapted to adjust a height of the first bed section or second bed section; wherein the first length is about 3 to about 4 times the second length.

Embodiment 2: The system of Embodiment 1, wherein the first bed section comprises the height adjustment mechanism.

Embodiment 3: The system of any one of Embodiments 1 and 2, wherein the second bed section comprises the height adjustment mechanism.

Embodiment 4: The system of any one of Embodiments 1-3, wherein the height adjustment mechanism comprises an actuator adapted to drive the at least one height adjustment mechanism.

Embodiment 5: The system of any one of Embodiments 1-4, wherein the height adjustment mechanism is a scissor lift.

Embodiment 6: The system of any one of Embodiments 1-5, wherein the actuator comprises a linear actuator.

Embodiment 7: The system of Embodiment 6, wherein the linear actuator comprises one or more of a piston and a screw drive.

Embodiment 8: The system of any one of Embodiments 1-7, wherein the actuator comprises an electric motor.

Embodiment 9: The system of any one of Embodiments 1-8, wherein the actuator comprises a manually powered mechanism.

Embodiment 10: The system of any one of Embodiments 1-9, wherein the first length is about 60 to about 64 inches.

Embodiment 11: The system of any one of Embodiments 1-10, wherein the second length is about 16 to about 20 inches.

Embodiment 12: The system of any one of Embodiments 1-11, further comprising a pivotally adjustable platform pivotally attached to the second bed section adapted to change the angle of the pivotally adjustable platform relative to the second bed section and/or the first bed section.

Embodiment 13: The system of Embodiment 12, further comprising a platform actuator adapted to move the pivotally adjustable platform.

Embodiment 14: The system of any one of Embodiments 1-13, further comprising a bed skirt adapted to fit along at least one or more sides of a frame supporting the first bed section and/or the second bed section.

Embodiment 15: The system of any one of Embodiments 1-14, wherein the bed skirt comprises an extensible accordion or stretchable material.

Embodiment 16: The system of any one of Embodiments 1-15, wherein the second bed section comprises a left second bed section and a right second bed section.

Embodiment 17: The system of Embodiment 16, wherein the left second bed section comprises a first height adjustment mechanism and the right second bed section comprises a second height adjustment mechanism.

Embodiment 18: The system of any one of Embodiments 16 and 17, further comprising a first actuator adapted to drive the first height adjustment mechanism and a second actuator adapted to drive the second height adjustment mechanism.

Embodiment 19: The system of any one of Embodiments 1-18, wherein the second bed section comprises two bed sections each having a width equal to the width of the other.

Embodiment 20: The system of any one of Embodiments 1-19, further comprising a transitional cover attached on a first edge to the first bed section and on a second edge to the second bed section.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. An adjustable sleep system, comprising:

one of a boxspring or a bed frame;

a first longitudinal bed section having a first length, the first longitudinal bed section being sized and configured for supporting a user's legs and torso;

a second longitudinal bed section abutting and directly adjacent to the first longitudinal bed section having a second length, the first length being 3 to 4 times the second length, the second longitudinal bed section being sized and configured for supporting a user's shoulders, arms, and head; and at least one of the first longitudinal bed section or second bed section comprising:

a platform including an upper member and a lower member; and a height adjustment mechanism disposed between the upper member and the lower member of the platform, the height adjustment mechanism adapted to adjust a height of the upper member relative to the lower member, a lowermost surface of the lower member of the platform being substantially planar and having a width and a length substantially equal to a width and the length of the at least one of the first longitudinal bed section or second bed section, the lowermost surface of the lower member of the platform resting on top of an uppermost surface of the boxspring or the bed frame.

2. The system of claim 1, wherein the first longitudinal bed section comprises the height adjustment mechanism.

3. The system of claim 1, wherein the second bed section comprises the height adjustment mechanism.

4. The system of claim 1, wherein the height adjustment mechanism comprises an actuator adapted to drive the height adjustment mechanism.

5. The system of claim 1, wherein the height adjustment mechanism is a scissor lift.

6. The system of claim 4, wherein the actuator comprises one or more linear or rotary actuators.

7. The system of claim 6, wherein the one or more linear or rotary actuators comprises one or more of a piston and a screw drive.

8. The system of claim 4, wherein the actuator comprises an electric motor.

9. The system of claim 4, wherein the actuator comprises a manually powered mechanism.

10. The system of claim 1, wherein the first length is 60 to 64 inches.

11. The system of claim 1, wherein the second length is 16 to 20 inches.

12. The system of claim 1, further comprising a pivotally adjustable platform pivotally attached to the second bed section adapted to change the angle of the pivotally adjustable platform relative to one or more of the second bed section and the first longitudinal bed section such that the pivotally adjustable platform is declined relative to an uppermost surface of the first longitudinal bed section.

13. The system of claim 12, further comprising a platform actuator adapted to move the pivotally adjustable platform.

14. The system of claim 1, further comprising a skirt connected to the upper member and the lower member of the platform and configured to conceal and protect the height adjustment mechanism from interference.

15. The system of claim 14, wherein the skirt comprises an extensible accordion or stretchable material.

16. The system of claim 1, wherein the second bed section comprises a left second bed section and a right second bed section.

17. The system of claim 16, wherein the left second bed section comprises a first height adjustment mechanism and the right second bed section comprises a second height adjustment mechanism.

18. The system of claim 17, further comprising a first actuator adapted to drive the first height adjustment mechanism and a second actuator adapted to drive the second height adjustment mechanism.

19. The system of claim 1, wherein the second bed section comprises two bed sections each having a width equal to the width of the other.

20. The system of claim 1, further comprising a transitional cover attached on a first edge to the first longitudinal bed section and on a second edge to the second bed section.

* * * * *